US005336984A

United States Patent [19]

Mischenko et al.

[11] Patent Number: 5,336,984

[45] Date of Patent: Aug. 9, 1994

[54] ELECTRONIC DEVICE POWERING SYSTEM

[75] Inventors: Nicholas Mischenko, Mount Prospect; Scott B. Davis, Buffalo Grove, both of Ill.

[73] Assignee: Motorola, Inc., Schaumburg, Ill.

[21] Appl. No.: 939,336

[22] Filed: Sep. 2, 1992

[51] Int. Cl.[5] ..... H01R 13/703

[52] U.S. Cl. ..... 320/2; 439/188

[58] Field of Search ..... 320/2; 439/188

[56] References Cited

U.S. PATENT DOCUMENTS 4,420,216 12/1983 Motoyama et al. ..... 439/188

4,904,196 2/1990 Sueyoshi et al. ..... 439/188

5,137,464 8/1992 Maue et al. ..... 439/188

*Primary Examiner*—R. J. Hickey

*Attorney, Agent, or Firm*—John J. King; Kenneth W. Bolvin

[57] ABSTRACT

The electronic device powering system enables a battery powered device to power another device needing power while also powering itself. The accessory power connector (102) makes a connection before breaking it by a spring contact (110) that is more flexible in one end (111) than the other (112). This allows the less flexible end (112) to force the internal power connector (104) in the electronic device to break its connection.

3 Claims, 1 Drawing Sheet

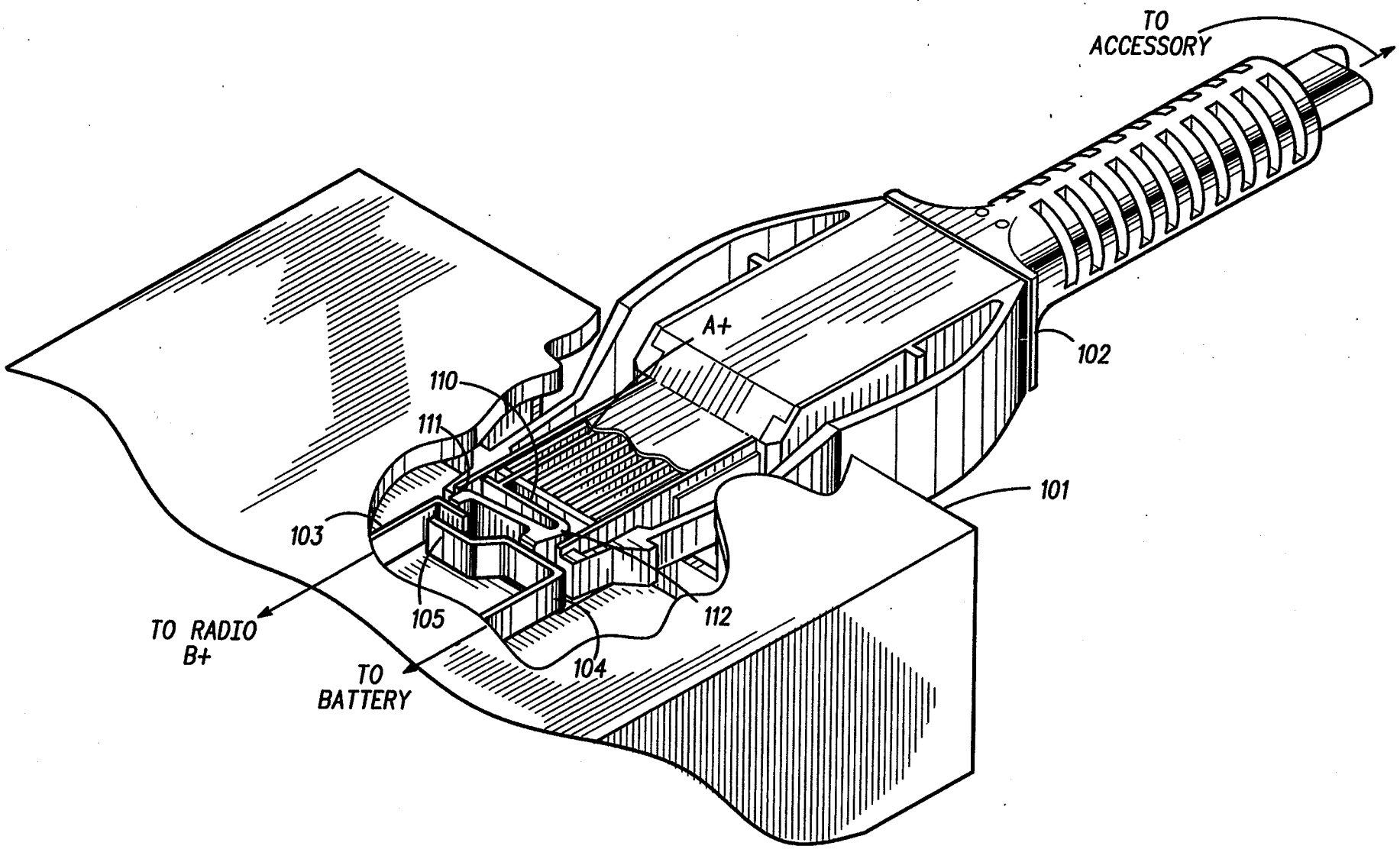
TO ACCESSORY
102
101
A+
112
104
110
111
105
103
TO BATTERY
TO RADIO B+

ELECTRONIC DEVICE POWERING SYSTEM

FIELD OF THE INVENTION

The present invention relates generally to the field of powering portable electronic devices.

BACKGROUND OF THE INVENTION

Portable communication devices have gained greatly in popularity. An example of such a device is a radiotelephone that can be carried away from landline telephones and fixed power sources. These portable radiotelephones are powered by rechargeable batteries. The radiotelephones typically have a connector allowing the radiotelephone to be powered externally in case the battery is dead or to save the battery for portable use. In order to prevent a dead battery from loading down the external power source, thereby preventing the power source from powering the radiotelephone, the external power connector typically breaks the battery connection from the radiotelephone when an external power connector is connected.

Accessories such as facsimile machines and modems are also being used increasingly as portable devices. By combining a facsimile machine or modem with a radiotelephone, a user is able to send and receive data and documents away from the office.

One problem with portable devices is power. Typically, they must be battery powered in order to be truly mobile. Batteries, however, add extra weight, complexity, and expense to the portable device. There is a resulting need for an apparatus to power both a portable communication device, having a power connector that breaks the battery connection from the radiotelephone, and an accessory from a single battery.

SUMMARY OF THE INVENTION

The electronic device power system of the present invention powers an electronic device by another electronic device that has a battery. The system is comprised of a first contact coupled to the battery and a second, flexible contact coupled to the electronic components of the device with the battery. The second contact is coupled to the first contact while in an internal powering mode. A third, flexible contact, located in external powering means, has a first protrusion portion that is coupled to the first contact while the powering device is in an external powering mode. A second protrusion portion of the third contact is coupled to the second contact while in the external powering mode. The second protrusion portion is less flexible than the first protrusion portion. This forces the second contact away from the first contact while in the external powering mode.

BRIEF DESCRIPTION OF THE DRAWINGS

The FIGURE shows the power connectors of the present invention.

DETAILED DESCRIPTION OF THE PREFERRED EMBODIMENT

The electronic powering system of the present invention provides power from a portable, battery powered device to another portable electronic device that does not have a battery. This enables the portable device being powered to operate without the added weight, expense, and bulk of a battery.

The figure illustrates the powering system of the present invention. The system is comprised of the battery powered device (101) and the accessory power connector and cable (102) that takes the power from the battery to the accessory that needs powering.

The connector in the battery powered device (101) is comprised of two separate contacts (103 and 104). One contact (103) is connected to the electronics of the device (101) while the other contact (104) is connected to the battery. The contact (104) that is coupled to the battery is flexible enough to bend away from the other contact (103). This flexible contact (104) has a slight "S" curve at the end (105) so that the end goes under the other contact (103). When the device (101) is being used without the accessory power connector (102), both contacts (103 and 104) are held together by the flexible contact's spring force and the battery power is conducted to the electronics of the device (101).

The accessory power connector (102) is comprised of a "U" shaped contact (110). Because of this shape, the end (111) of the contact (110) is more flexible than the bottom of the "U" (112). Both the end (111) and the bottom (112) of the "U" have protrusions from the normal thickness of the contact (110). These protrusions provide a better connection between the accessory contact (110) and the device's contacts (103 and 104).

When the power connector (102) is inserted in a receptacle in the battery powered device (101), it connects the accessory contact (110) to the device's contacts (103 and 104). Since one side (111) of the accessory contact (110) is more flexible than the other (112), the less flexible side (112) will force the battery contact (104) down and away from the electronics contact (103). This disconnects the device's (101) battery from the electronics portion of the device (101). The accessory power connector (102) thus conducts power from the battery to the accessory needing power. The accessory power connector (102) also reconnects the battery contact (104) to the electronics contact (103), which allows the electronics to be powered at the same time as the accessory. The power connector (102) also contains a ground connection between the accessory and the battery powered device (101) to complete the circuit.

We claim:

1. An electronic device powering system, a first electronic device being powered by a second electronic device having a battery, electronic components, an internal powering mode, an external powering mode, and accepting external powering means, the electronic device powering system comprising:

a first flexible contact coupled to the battery;

a second contact coupled to the electronic components and coupled to the first flexible contact in the internal powering mode; and a third, flexible contact located in the external powering means, the third contact having a first protrusion portion coupled to the first flexible contact in the external powering mode and a second protrusion portion coupled to the second contact in the external powering mode, the first protrusion portion being less flexible than the second protrusion portion, thus forcing the first contact away from the second contact in the external powering mode.

2. The powering system of claim 1 wherein the external powering means is a connector coupled to a cable that supplies power from the battery to the first electronic device.

3. An electronic device power system, a first electronic device being powered by a second electronic device having a battery, electronic components, an internal powering mode, an external powering mode, and accepting external powering means, the electronic device power system comprising:

a first flexible contact coupled to the battery;

a second contact coupled to the electronic components and coupled to the first flexible contact in the internal powering mode, the second contact coupled under the first flexible contact; and a third, flexible, substantially U-shaped contact located in the external powering means, the third contact having a first protrusion portion coupled to the first contact in the external powering mode and a second protrusion portion coupled to the second contact in the external powering mode, the first protrusion portion being less flexible than the second protrusion portion, thus forcing the first contact down from the second contact in the external powering mode.

* * * * *